US006098818A

United States Patent [19]

Ali et al.

[11] Patent Number: 6,098,818

[45] Date of Patent: Aug. 8, 2000

[54] DISPLAY STAND

[75] Inventors: Terry Ali; Christopher Ali; Phillip Glenn Ali, all of Fairborn, Ohio

[73] Assignee: Ali Industries, Inc., Fairborn, Ohio

[21] Appl. No.: 09/383,155

[22] Filed: Aug. 25, 1999

[51] Int. Cl.[7] ..... A47F 7/00

[52] U.S. Cl. ..... 211/50; 211/57.1; 211/89.01

[58] Field of Search ..... 211/50, 89.01, 211/57.1, 59.1, 49.1, 72; 248/174, 316.7; 312/60

[56] References Cited

U.S. PATENT DOCUMENTS

| | | | |
|---|---|---|---|
| 2,927,697 | 3/1960 | Hoover | 211/181.1 X |
| 2,994,441 | 8/1961 | Browning | 211/181.1 X |
| 3,162,462 | 12/1964 | Elders | 211/181.1 X |
| 4,043,485 | 8/1977 | Tippetts | 312/60 X |
| 5,253,770 | 10/1993 | Rosenthal | 211/106 X |
| 5,415,514 | 5/1995 | Butterfield | 211/50 X |
| 5,497,877 | 3/1996 | Ali et al. | 211/50 X |
| 5,564,566 | 10/1996 | Lamb | 211/70.6 X |
| 5,692,714 | 12/1997 | Morrison | 248/174 |
| 5,967,341 | 10/1999 | Werner | 248/316.7 X |

*Primary Examiner*—Robert W. Gibson, Jr.
*Attorney, Agent, or Firm*—R. William Graham

[57] ABSTRACT

A floor display stand which improves the visibility of the displayed items while providing easy self-service access to the items by the consumer. The configuration of the floor display stand includes a horizontal base or shelf, two parallel panel vertical side members and a vertical back member. The vertical side panel members and the back panel member are connected to the horizontal base or shelf such that the base or shelf is positioned at a predetermined distance from the floor. The front edge of each of the two side panel members contains an inwardly directed flange which extends a predetermined distance along the front edge of the side panel member such that the distance between the leading edges of the two flanges is less than the distance between the two parallel side panel members so packages or sheets of displayed material, when stacked horizontally on the base or shelf, are prevented from sliding out of the display stand.

11 Claims, 1 Drawing Sheet

DISPLAY STAND

BACKGROUND OF THE INVENTION

1. Field of the Invention

The invention relates generally to the field of display stands. More particularly, but not by way of limitation, the present invention relates to an improved display stand for displaying and holding packages and/or sheets of sandpaper.

2. Related art

There exist a number of display stands for displaying abrasive sheets, discs, wheels, and the like. Most commonly, these goods are placed flat on a shelf in a stacked manner and slideably removed from the shelf. Another common method of displaying such goods is to dispose the goods within a packing material having a paper tab portion with an eyelet therein such that the goods hang on a peg board type stand.

Some of these goods, e.g., abrasive discs, are heavy and are relatively limited in number of units which can be horizontally displayed on a peg board type stand. Such goods can be stacked in large numbers on a shelf in a flat manner, this is not as preferred since the goods are not as easily viewed by the customer. Additionally, peg board type displays typically use a packaging to hold the goods, which adds further cost to the product.

Retail stores are extremely concerned about the methods of displaying goods in an efficient manner which is easily utilized by the consumer. Consequently, retail stores are continuously searching for better ways to display goods.

Traditionally, retail hardware and do-it-yourself stores throughout the country using stock shelving which has a rectangular metal 3" framework having sides and shelves which removably interlock. Horizontal support members of the framework are configured with an L-shaped ¾" recess which extends longitudinally along the inside of the horizontal support members. ¾" thick boards are cut to fit between the horizontal support members such that the ends of the boards rest in the L-shaped recess. The goods are then slid directly or are placed in containers which are then shelved.

With a growing need to utilize space and increase sales, there remains a need to invent new ways to shelve and display goods. In the field of abrasives, there likewise remains a need to provide novel floor display stands.

BRIEF SUMMARY OF THE INVENTION

It is an object to improve display stands.

It is yet another object to improve stands which display abrasives.

It is yet another object to provide a stand with improved functional and aesthetic characteristics.

It is still another object to provide a floor display stand with improved space saving design while maintaining user friendly aspects.

Accordingly, the present invention is directed to a display stand and particularly to a floor display stand which improves the visibility of the displayed items while providing easy self-service access to the items by the consumer. Furthermore, the configuration of the display stand of the invention provides for the display of more than one type of item in a convenient, self-contained display stand which can be easily moved to various locations, e.g., near check-out lanes for improved visibility.

In one aspect of the invention, the display stand comprises a horizontal base or shelf, two parallel panel vertical side members and a vertical back member. The vertical side panel members and the back panel member are connected to the horizontal base or shelf such that the base or shelf is positioned at a predetermined distance from the floor. The front edge of each of the two side panel members contains an inwardly directed flange which extends a predetermined distance along the front edge of the side panel member such that the distance between the leading edges of the two flanges is less than the distance between the two parallel side panel members so packages or sheets of displayed material, when stacked horizontally on the base or shelf, are prevented from sliding out of the display stand.

In another aspect of the invention the side panel members and the back panel member contains a plurality of fasteners in the outside surface of the side panels and the rear panel for securing items which are packaged in bag type enclosures, e.g., sanding blocks, and the like packaged in plastic bags having a tab with eyelet therein for securing the bags to the display panel. The fasteners can be a tension clip, clamp, hook or spring activated coupler.

Other objects and advantages will be readily apparent to those skilled in the art upon viewing the drawings and reading the detailed description hereafter.

DETAILED DESCRIPTION OF THE INVENTION

Figures 1, 2, 3, 4:
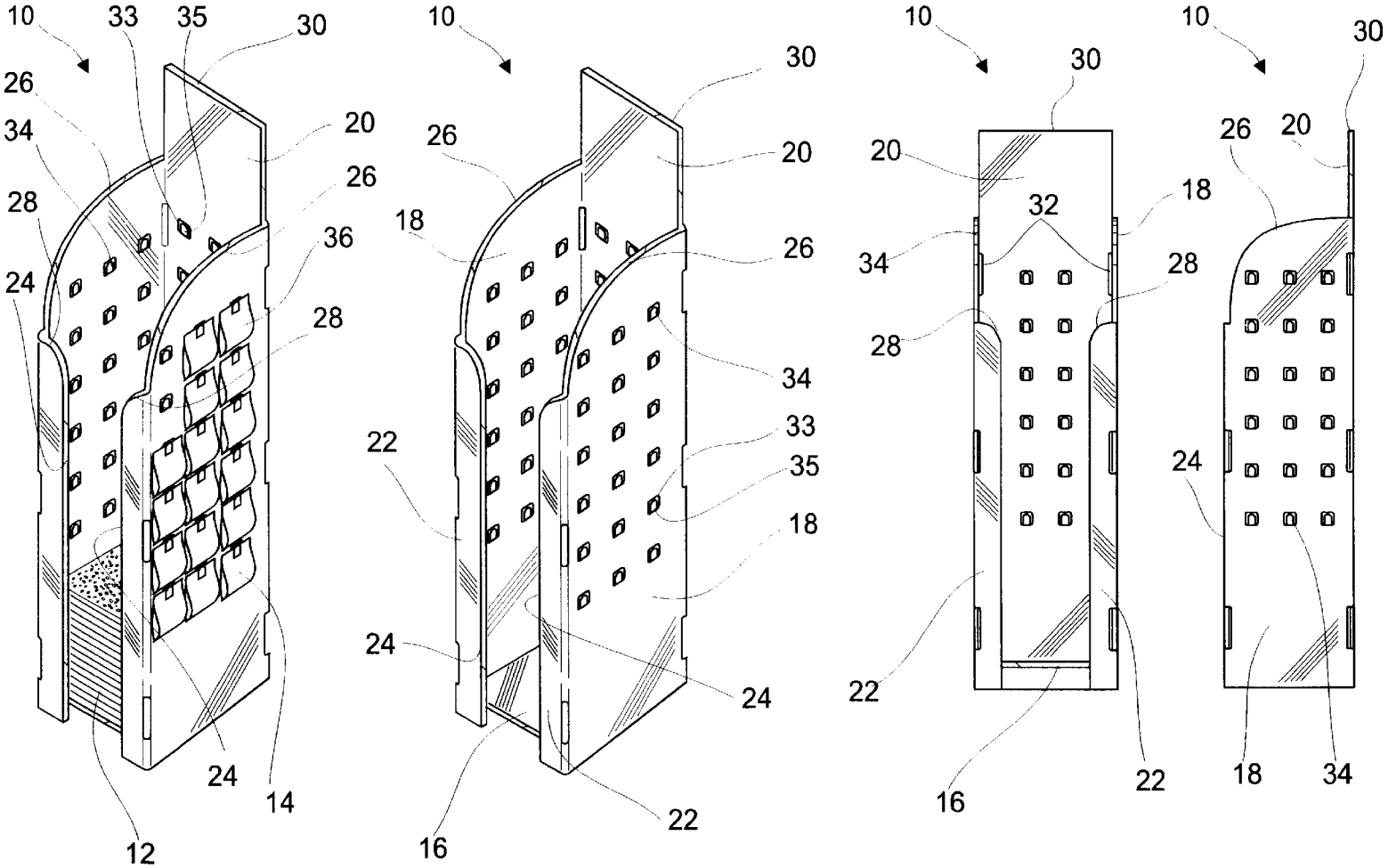
FIG. 1 is a perspective view of a display stand of the present invention in use.
FIG. 2 is another perspective view of a display stand of FIG. 1.
FIG. 3 is a front view of a display stand of FIG. 1.
FIG. 4 is a side view of a display stand of FIG. 1.

Referring now to the drawings, FIG. 1 shows a floor display stand 10 which displays and stores self-service display products 12 such as packaged sheets of sandpaper and related packaged items 14, e.g., sanding blocks, and the like. The display stand 10 is constructed to have a base 16 which serves as a shelf for the packaged products 12. Attached to the base 16 are two vertical side panels 18, and a vertical rear panel 20. The rear panel 20 is attached along its opposite edges to the two side panels 18 to form of a container. The two vertical side panels 18 include flanges 22 which are disposed inwardly at an angle of about 90° with respect to the side panels 18. The flange reduces the open area between the vertical edges 24 of the flanges 22 to store the packages or sheets of sandpaper and prevent them from inadvertently falling out of the display stand 10. The side panel 18 and the rear panel 20 have a plurality of fasteners 34 such as tension clips, hooks, clamps, spring activated couplers, or hook and loop material.

The fasteners 34 are preferably integrally formed in the panels 18 and 20. More particularly, within the side panels 18 and rear panel 20 are spatially disposed generally inverted U-shaped open surfaces 33 which define integrally formed upwardly extending fingers 35, wherein these components make up the fasteners 34. An advantage gained by the design is a dual marketing capability of products which are typically marketed for use with one another. Rather than shelving associated items in different locations of a retail store, the items are conveniently located on the same display stand 10. Moreover, the display stand 10 can be positioned at many impulse buying locations throughout a retail store such as a checkout lane.

Each of the upper edges 26 of the vertical side panels 18 and each of the upper edges 28 of the flanges 22 have a curved surface as shown in FIGS. 1–4 which, in addition to other advantages, serve to improve visibility of product and reduce hazards by reducing or eliminating sharp corners. For illustrative purposes, the vertical back panel 20 is shown having a linear horizontal top edge 30 and the rear panel 20 of the display stand 10 is typically positioned adjacent a wall or other structure such that the comers present no apparent danger; however, the top edge 30 of the vertical back panel 20 may, optionally, be curved or other configuration to eliminate any sharp comers, if desired.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A display stand for displaying sheets or packages of abrasive material, wherein said display stand includes a base having four sides upon which sheets or packages of abrasive material can rest;

a first side panel extending vertically from one side of said base;

a second side panel extending vertically from another side of said base such that said first and said second side panels are approximately disposed to form side walls of said display stand;

a rear panel extending vertically from said base to form a rear wall of said display stand; and wherein at least one of said first side panel, said second side panel and said rear panel contain a plurality of spatially disposed generally inverted U-shaped open surfaces, each said open surface defining and integrally formed upwardly extending finger therein for securing a plurality of packages of related sanding items to said panels, wherein the packages are of the type which include a tab having an eyelet for hanging upon said finger.

2. The display stand of claim 1, wherein said first and said second side panels further include flanges extending inwardly with respect to said first and said second side panels.

3. The display stand of claim 2, wherein said flanges extend inwardly at an angle of about 90° with respect to said first and second side panels.

4. The display stand of claim 1, wherein the top edges of said first and said side panels are non-linear.

5. The display stand of claim 4, wherein the top edges of said first and said second side panels are curved.

6. The display stand of claim 1, wherein the top edge of said rear panel is linear.

7. The display stand of claim 1, wherein all said panels are characterized to include said U-shaped open surfaces and integrally formed fingers.

8. The display stand of claim 1, wherein said display stand includes a plurality of apertures along the junction of the first and second side panels and the flanges, and along the junction of the first and second side panels and the back panel.

9. The display stand of claim 8, wherein said apertures characterized as being oblong.

10. The display stand of claim 1, wherein said base is equally joined to said first and said second side panel, and said rear panel at a predetermined distance from a floor.

11. The display stand of claim 1, wherein said display stand is a unitary structure.

* * * * *